United States Patent [19]

Mizelle

[11] 4,447,950

[45] May 15, 1984

[54] POCKET KNIFE

[76] Inventor: Ned W. Mizelle, 604 Idol Dr., High Point, N.C. 27262

[21] Appl. No.: 364,742

[22] Filed: Apr. 2, 1982

[51] Int. Cl.[3] ..... B26B 1/02

[52] U.S. Cl. ..... 30/155

[58] Field of Search ..... 7/118, 158, 170; 30/155, 156, 157

[56] References Cited

U.S. PATENT DOCUMENTS

| | | | |
|---|---|---|---|
| 1,942,220 | 1/1934 | Segal | 30/155 X |
| 2,052,741 | 9/1936 | Bersted | 30/155 X |
| 2,162,654 | 6/1939 | Vaisey | 30/155 |
| 3,600,729 | 8/1971 | Laughlin | 7/118 |
| 4,312,128 | 1/1982 | Olsen | 30/157 |

*Primary Examiner*—Jimmy C. Peters

*Attorney, Agent, or Firm*—Beveridge, DeGrandi and Kline

[57] ABSTRACT

A combined pocket knife and money clip has a casing formed of two disc like pieces of injection molded plastic which have a cavity therebetween, a grommet which extends through the casing, a blade pivotally supported on the grommet within the cavity, a spring clip which is retained on the casing by the grommet and cooperates with the casing as a money clip, and a linear spring wire within the casing. The spring wire acts on a cam portion of the blade to bias the blade to an interior position in the cavity and to an exterior position where its cutting edge is located outside the casing.

1 Claim, 4 Drawing Figures

POCKET KNIFE

BACKGROUND OF THE INVENTION

This invention relates to a pocket knife structure, and to a combined pocket knife and money clip.

Prior to this invention, there have been devices which serve the combined functions of knife, money clip and key chain; and, there have been various proposals for circular pocket knives which have a circular configuration. The following patents located during a preliminary patentability search are exemplary of the prior art:

U.S. Pat. No. Des. 161,261
U.S. Pat. No. Des. 185,894
U.S. Pat. No. Des. 193,477
U.S. Pat. No. Des. 221,412
U.S. Pat. No. 73,674
U.S. Pat. No. 881,125
U.S. Pat. No. 1,466,438
U.S. Pat. No. 1,942,220
U.S. Pat. No. 1,969,100
U.S. Pat. No. 2,162,654
U.S. Pat. No. 3,415,250.

The present invention is believed to comprise a simplified device which utilizes a small number of components which are themselves uncomplicated and inexpensive to manufacture and assemble.

SUMMARY OF THE INVENTION

The invention involves several different aspects which may be used independently of or together with each other. All aspects involve a basic pocket knife structure, previously known, which includes the following components: a casing with two opposite faces and an interior cavity which is substantially parallel to the faces; a fastener which extends through the casing; a blade which is pivotally supported on the fastener and is movable from an interior position where its cutting edge is located in the cavity to an exterior position where its cutting edge is located outside the casing; and, an internal spring in the cavity which bears on a cam surface of the blade to bias the blade to its interior position and to its exterior position.

According to one aspect of the invention, the fastener which pivotally supports the blade also connects a spring clip to the exterior of the casing. The spring clip has a resiliently movable end which is spaced from the fastener and bears against a face of the casing, enabling it to serve as a money clip.

In another respect, the invention involves the basic structure wherein the casing is formed of two substantially parallel pieces of injection molded plastic. These pieces are in direct contact with each other and together they comprise the total thickness of the casing. One of the pieces has a recessed surface to provide the cavity.

The invention also comprises an improvement to the basic structure wherein the internal spring is a resilient wire which is linear when in its unstressed condition. The wire has a fixed end affixed to the casing and a free end which is movable relative to the casing. A fulcrum is located on the interior of the casing. The resilient wire has a portion located between the fulcrum and the free end which bears against the cam surface of the blade. Pivotal movement of the blade will cause the wire to flex about the fulcrum in a same direction of curvature between its fixed end and the fulcrum and between its free end and the fulcrum.

Together with the inventive concepts mentioned above, the invention contemplates the use of a fastener which is a grommet with a central opening therein, a casing which has a notch in its perimeter to permit manual grasping of the blade, and a lip on the fixed end of the spring clip to wrap around the edge of the casing to prevent the spring clip from pivoting about the fastener.

These and other advantageous features will be appreciated from the following disclosure which is exemplary of but one possible embodiment of the invention.

BRIEF DESCRIPTION OF A PREFERRED EMBODIMENT

Figure 1:
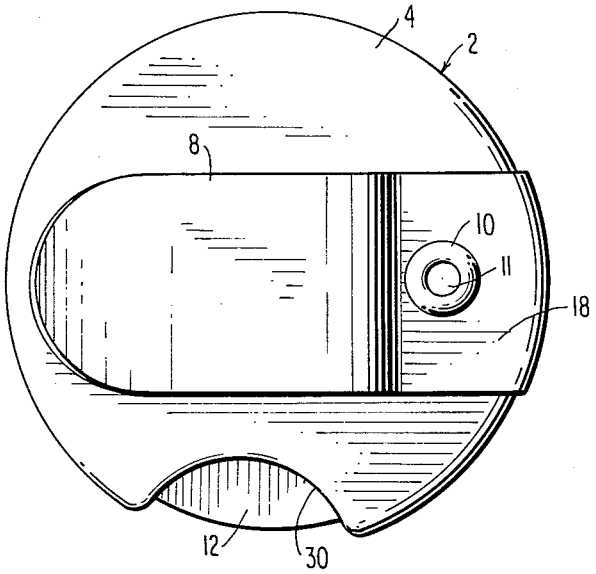
FIG. 1 is a plan view of a device constructed according to the invention.
Figure 2:
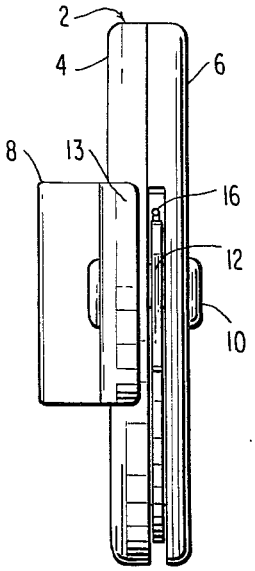
FIG. 2 is an end view of the device.

Referring to the drawings, it will be seen that the device includes a casing 2 formed of two disc-like pieces 4 and 6 of molded plastic, a spring clip 8 attached to the casing by a grommet fastener 10, and a blade 12 which is pivotally mounted on the grommet. The blade 12 is movable between an interior position in the casing and an exterior position where its cutting edge 14 is located outside the casing. On the interior of the casing 2, there is a piano wire spring 16 which is operable to bias the blade to its interior position and to its exterior position as will be explained below.

In its preferred form, the invention serves as a knife, a money clip and a key chain. In connection with the latter, the grommet 10 has a central opening 11 for receiving a conventional ball chain. The money clip function is provided by the spring clip 8 and the upper face of the casing 2. The spring clip 8 has a fixed end 18 which is held to the casing solely by the grommet. The grommet extends through a preformed hole in the clip, and it has an upper flange which bears on the upper surface of the clip. The spring clip 8 has an integral lip portion 13 which wraps around the edge of the casing 2 to prevent its pivotal movement about the grommet.

Figure 3:
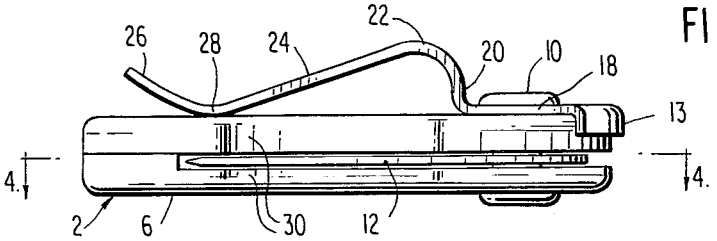
FIG. 3 is a side elevational view of the device.

The spring clip is formed of resilient material, preferably metal. Its left end as seen in FIG. 3 is resiliently movable. This movable portion includes a vertical section 20, a convex section 22, a descending section 24, and an upturned lip 26 which facilitates the insertion of folded paper currency. At 28, the spring clip bears against the face of the casing in order to hold money securely in position against the casing.

The two pieces 4 and 6 of the casing 2 are formed separately by an injection molding process. When assembled, they are substantially parallel and in direct contact with each other, preferably being joined together by solvent bonding, ultrasonic bonding, or thermal bonding. The edges of both pieces have semicircular notches 30 which expose a portion of the blade and permit manual grasping thereof to move the blade from its interior position to its exterior position.

Figure 4:
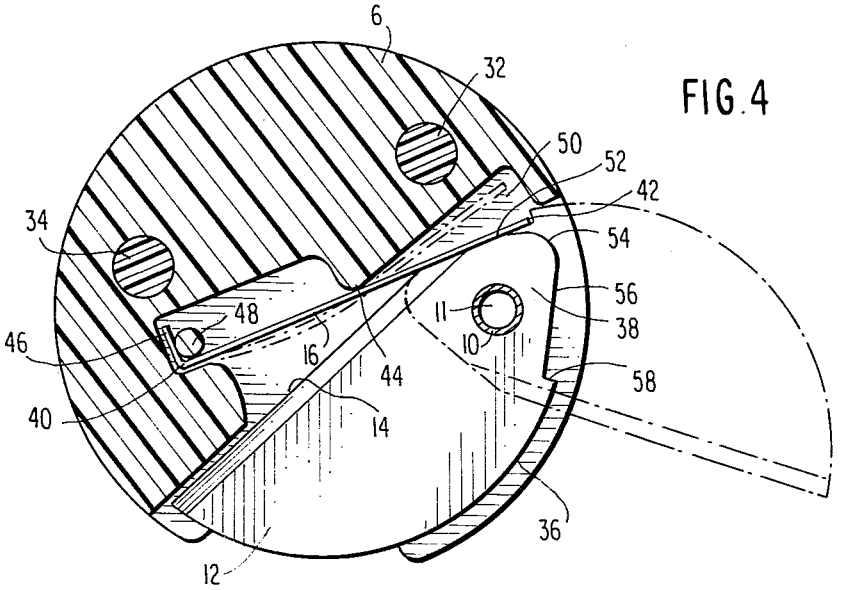
FIG. 4 is a sectional view thereof as seen along the line 4—4 in FIG. 3.

The molded upper piece 4 has an opening for receiving the grommet, and it also has two downwardly projecting bosses 32 and 34 which are received in mating apertures in the lower piece 6 as shown in FIG. 4.

The lower piece 6 has a recess in its upper face so that the assembled casing 2 will have a blade-receiving cavity which lies substantially parallel to the upper and lower faces of the casing. The configuration of the recess and cavity are best shown in FIG. 4. In this drawing, the interior position of the blade 12 appears in solid lines, and its exterior position is shown in broken lines.

The blade has a linear cutting edge 14 and an arcuate rear edge 36 which is concentric with the casing when the blade is in its interior position. Near its pivotal support and within the cavity, the blade 12 has a cam portion 38 which engages the spring wire 16.

The wire 16 is linear when in its unstressed condition. It has a fixed end 40 attached to the casing 2, a free end 42 which is movable relative to the casing, and a mid-portion which bears against a fulcrum surface 44 of the casing. The spring portion located between the fulcrum 44 and the free end 42 bears against the edge of the cam portion 38 of the blade. At its fixed end, the spring wire 16 is bent at a right angle to provide an integral foot portion 46. The fixed end 40 is immovably held in a corner of the recess by a pin 48 formed integrally in the lower piece 6. The recess also has a portion 50 into which the wire flexes as the blade 12 moves from its interior position to its exterior position. This configuration of the recess permits the wire to flex about the fulcrum 44 in a same direction of curvature both between its fixed end 40 and the fulcrum 44, and between its free end 42 and the fulcrum 44. This direction of curvature is upwardly concave from the vantage point shown in FIG. 4.

The cam portion 38 of the blade has a low segment 52 which contacts the spring wire 16 when the blade 12 is in its interior position, a high segment 54 which contacts the spring 16 when the blade 12 is midway between its interior position and its exterior position, and a second low segment 56 which contacts the spring when the blade 12 is in its exterior position. It will be observed that this configuration causes the spring 16 to engage the cam surface and bias the blade 12 to its interior position and to its exterior position.

The blade also has a shoulder 58 which is positioned where it will contact the free end 42 of the spring wire 16 when the blade is in its exterior position. This contacting relationship places the spring wire 16 under axial compression and prevents pivotal movement of the blade beyond its exterior position.

Persons familiar with this art will realize that the device of the invention is indeed simple, inexpensive and effective. They will also realize that the principles of the invention may be utilized in a variety of devices which differ in many respects from the disclosed embodiment. For example, in some cases the spring clip 8 and/or the spring 16 may be formed of plastic and molded integrally with the respective casing pieces. Therefore, it is emphasized that the invention is not limited to the disclosed embodiment but is embracing of numerous variations thereto and modifications thereof which fall within the scope of the following claims.

I claim:

1. A combined pocket knife and money clip, comprising, a casing which has a substantially circular perimeter, said casing including two casing members which are formed of molded plastic and are in direct contact with each other, said casing members each having a substantially circular external face, said casing having an interior cavity which is substantially parallel to said faces, a grommet extending through the thickness of the casing and provided with a central opening for receiving a keychain, said grommet having a tubular section with radial flanges at its opposite ends, a blade which is provided with a cutting edge, said blade being pivotally supported on said grommet and being movable from an interior position where the cutting edge is located in said interior cavity to an exterior position where the cutting edge projects outwardly from said casing, said blade also including a cam surface which is located in said cavity, said casing having a notch in its perimeter which exposes a portion of the blade to permit manual grasping thereof for moving the blade from its interior position to its exterior position, a spring clip located on the exterior of the casing, said spring clip having a fixed end which is attached to the casing by the grommet, said fixed end wrapping around the perimeter of the casing to prevent the spring clip from pivoting about said grommet, said spring clip having a movable end which is spaced from the grommet and bears against a said face of the casing so as to be operable as a money clip, an internal spring located in said cavity for biasing the blade to its interior position and to its exterior position, said internal spring being a resilient wire which is linear when in an unstressed condition, said wire having a fixed end which is affixed to the casing and a free end which is movable relative to the casing, a fulcrum which is fixed relative to the casing, said internal spring having a portion located between the fulcrum and the free end which bears against the cam surface of the blade, said wire being free to flex so that pivotal movement of the blade will cause the wire to flex about said fulcrum in a same direction of curvature between its fixed end and the fulcrum and between its free end and the fulcrum, said blade having a shoulder which lies in abutting relationship with the end of the internal spring when the blade is in its exterior position.

* * * * *